US005146906A

United States Patent [19]

Agatsuma

[11] Patent Number: 5,146,906

[45] Date of Patent: Sep. 15, 1992

[54] IGNITION SYSTEM FOR INTERNAL COMBUSTION ENGINE

[75] Inventor: Eiji Agatsuma, Saitama, Japan

[73] Assignee: Honda Giken Kogyo Kabushiki Kaisha, Tokyo, Japan

[21] Appl. No.: 770,916

[22] Filed: Oct. 4, 1991

[30] Foreign Application Priority Data

Oct. 5, 1990 [JP] Japan ..... 2-268122

[51] Int. Cl.[5] ..... F02P 3/02; F02P 13/00; H01T 13/04; H01R 13/625

[52] U.S. Cl. ..... 123/634; 123/635; 336/110

[58] Field of Search ..... 123/90.22, 90.23, 193.5, 123/634, 635, 647, 169 PA; 336/110, 177

[56] References Cited

U.S. PATENT DOCUMENTS

| | | | |
|---|---|---|---|
| 4,546,753 | 10/1985 | Pierret | 123/634 |
| 4,627,407 | 12/1986 | Betz | 336/110 X |
| 4,751,430 | 6/1988 | Muller et al. | 123/634 X |
| 4,796,574 | 1/1989 | Fujii et al. | 123/90.23 |
| 4,831,995 | 5/1989 | Biton | 123/635 |
| 4,893,105 | 1/1990 | Maeda et al. | 123/634 X |
| 4,990,881 | 2/1991 | Ooyabu | 336/110 |
| 5,003,958 | 4/1991 | Yoneyama et al. | 123/635 |

FOREIGN PATENT DOCUMENTS

| | | | |
|---|---|---|---|
| 3920080 | 1/1991 | Fed. Rep. of Germany | 123/635 |
| 12165 | 1/1984 | Japan | 123/635 |
| 60-98288 | 7/1985 | Japan . | |
| 63-18116 | 1/1988 | Japan . | |

*Primary Examiner*—Willis R. Wolfe
*Attorney, Agent, or Firm*—Howard L. Rose

[57] ABSTRACT

An internal combustion engine includes a cylinder head having a plug insertion hole, an ignition plug inserted in the plug insertion hole and having an input terminal covered with a plug cap. An ignition system includes an ignition coil assembly having a primary coil, a secondary coil, and a core extending through the primary and secondary coils, the ignition coil assembly being disposed in the plug cap. The ignition system also includes magnets mounted on respective ends of the core, the magnets being oriented so as to produce magnetic fluxes in a direction opposite to magnetic fluxes generated by the primary coil. The ignition system also has a shield member of a magnetic material surrounding the ignition coil assembly, and an insulating member of an electrically nonconductive material interposed between the shield member and an inner wall surface of the plug insertion hole. The shield member is of a substantially cylindrical shape having an electrically nonconductive insulating region in a circumferential portion thereof.

8 Claims, 3 Drawing Sheets

IGNITION SYSTEM FOR INTERNAL COMBUSTION ENGINE

BACKGROUND OF THE INVENTION

1. Field of the Invention

The present invention relates to an ignition system for an internal combustion engine, and more particularly to an ignition system including an ignition coil assembly that comprises a primary coil and a secondary coil, the ignition coil assembly being disposed in a plug cap that covers a terminal of an ignition plug.

2. Description of the Related Art

Heretofore, there have widely been used ignition systems for internal combustion engines, the ignition systems including a high-tension cord connecting an output terminal of a secondary coil to an input terminal of an ignition plug. A noise suppressor resistor is connected either between the high-tension cord and the ignition plug terminal or in the ignition plug itself for suppressing electromagnetic noise that is induced by electric discharges between the central and ground electrodes of the ignition plug. The high-tension cord is required to be replaced periodically because of its limited dielectric strength and weather resistance.

Japanese Laid-Open Utility Model Publication No. 60-98288, published Jul. 4, 1985, discloses an ignition system that does not have such a high-tension cord. In the disclosed ignition system, an ignition plug is inserted in a plug insertion hole defined in the cylinder head of an engine, and has central and ground electrodes positioned in a combustion chamber of the engine. The ignition plug in the plug insertion hole has a proximal end covered with a plug cap that houses primary and secondary coils with a common core disposed therein. The secondary coil has an output terminal connected to the terminal of the ignition plug at its proximal end through a noise suppressor resistor. The ignition system of the above structure allows easy maintenance because it has no high-tension cord.

However, the common core of the proposed ignition system is small in diameter. Therefore, the magnetic field H generated by the primary coil and the magnetic fluxes B produced by the magnetic field H through the common core are related to each other such that, as shown in FIG. 4 of the accompanying drawings, the magnetic fluxes B reach a saturated region S even when the magnetic field H does not have a substantial magnitude. As a result, in the saturated region S, an increase $\Delta Bp$ in the magnetic fluxes B is not proportional to an increase $\Delta Hp$ in the magnetic field H produced under a predetermined voltage applied to the primary coil. Consequently, the voltage generated by the secondary coil is not sufficiently high, and the output voltage produced by the ignition coil assembly may be lowered.

In the disclosed ignition system, the cylinder head, which is made of metal, has a portion disposed around the primary and secondary coils in the plug cap. The magnetic fluxes produced by the primary coil induce an eddy current in the cylinder head portion, tending to generate magnetic fluxes in a direction to cancel out the magnetic fluxes generated by the primary coil. This phenomenon is also responsible for lowering the output voltage of the ignition coil assembly.

The present invention has been made to improve such an ignition system for an internal combustion engine which has no high-tension cord.

SUMMARY OF THE INVENTION

It is an object of the present invention to provide an ignition system for an internal combustion engine, the ignition system being dispensed with a high-tension cord for higher maintenability and capable of efficiently preventing the output voltage of an ignition coil assembly from being lowered.

According to the present invention, there is provided an ignition system of an internal combustion engine including a cylinder head having a plug insertion hole, a combustion chamber, an ignition plug inserted in the plug insertion hole and having electrodes exposed in the combustion chamber, the ignition plug having an input terminal, a plug cap covering the input terminal of the ignition plug, and an ignition coil assembly having a primary coil, a secondary coil, and a core extending through the primary and secondary coils, the ignition coil assembly being disposed in the plug cap, wherein the improvement comprises magnets mounted on respective ends of the core, the magnets being oriented so as to produce magnetic fluxes in a direction opposite to magnetic fluxes generated by the primary coil.

According to the present invention, there is also provided an ignition system of an internal combustion engine including a cylinder head having a plug insertion hole, a combustion chamber, an ignition plug inserted in the plug insertion hole and having electrodes exposed in the combustion chamber, the ignition plug having an input terminal, a plug cap covering the input terminal of the ignition plug, and an ignition coil assembly having a primary coil, a secondary coil, and a core extending through the primary and secondary coils, the ignition coil assembly being disposed in the plug cap, wherein the improvement comprises a shield member of a magnetic material surrounding the ignition coil assembly and electrically insulated from the cylinder head.

The above and other objects, features, and advantages of the present invention will become apparent from the following description of an illustrative embodiment thereof to be read in conjunction with the accompanying drawings, in which like reference numerals represent the same or similar objects.

DETAILED DESCRIPTION OF THE PREFERRED EMBODIMENT

Figure 1:
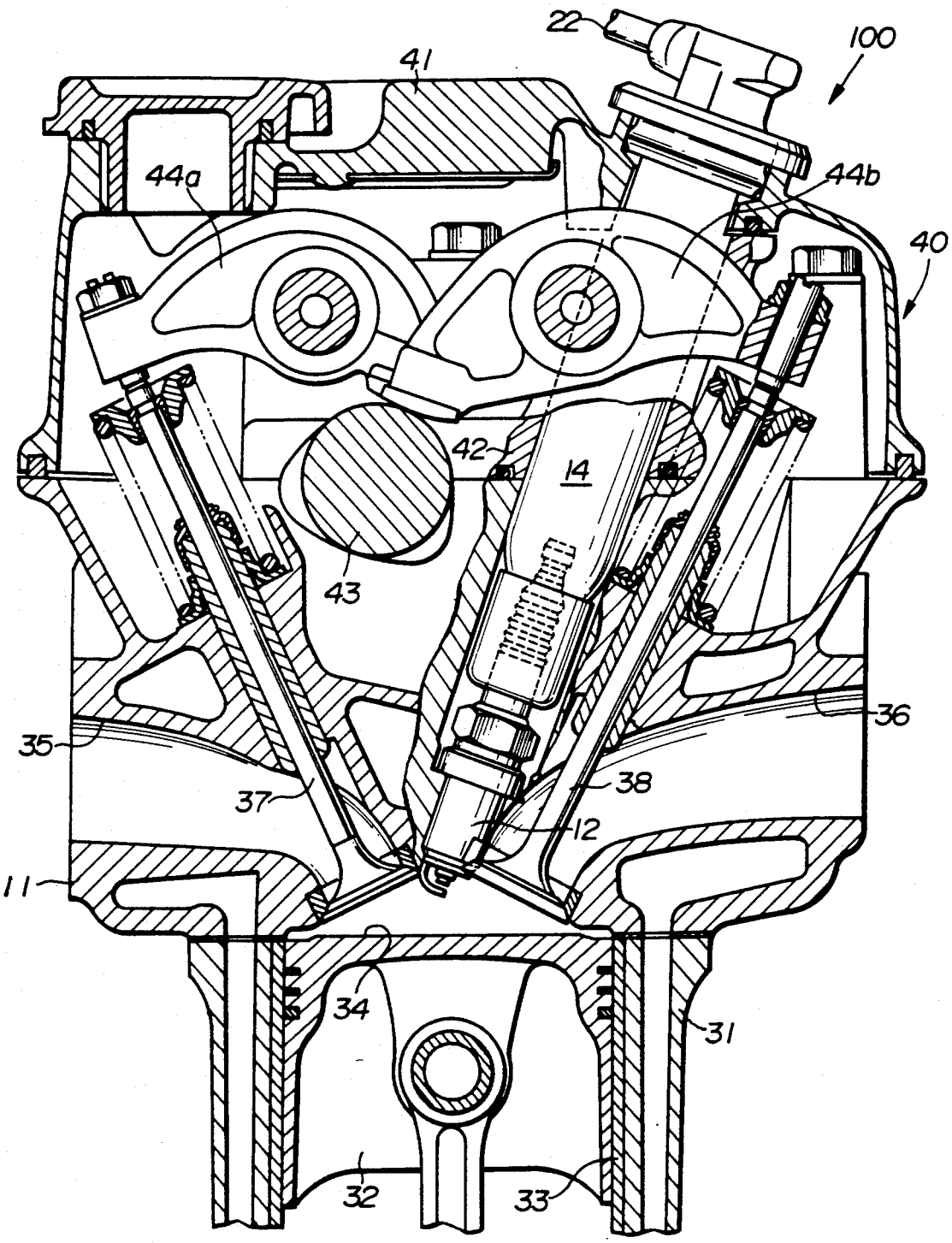
FIG. 1 is a cross-sectional view, partly in side elevation, of a cylinder head of an internal combustion engine incorporating an ignition system according to the present invention.

FIG. 1 shows an ignition system, generally designated by the reference numeral 100, incorporated in an internal combustion engine that has a cylinder head 11 of aluminum alloy or the like. The cylinder head 11 is fixedly mounted on a cylinder block 31 having a cylinder 33 defined therein with a piston 32 slidably fitted in the cylinder 33. The cylinder 33 has an upper opening closed by the cylinder head 11, defining a combustion chamber 34 jointly between the cylinder head 11 and the cylinder 33. The cylinder head 11 has an intake passage 35 and an exhaust passage 36 defined therein and opening into the combustion chamber 34. An OHC (overhead camshaft) valve operating mechanism 40 is disposed on an upper surface of the cylinder head 11. The cylinder head 11 supports an intake valve 37 positioned in the intake passage 35 and an exhaust valve 38 positioned in the exhaust passage 36. The intake and exhaust valves 37, 38 can be actuated by the valve operating mechanism 40 to open and close the intake and exhaust passages 35, 36, respectively, at predetermined timing.

The valve operating mechanism 40 comprises a camshaft 43, a rocker arm **44*a* for actuating the intake valve 37, and a rocker arm 44*b* for actuating the exhaust valve 38. The camshaft 43 is rotatably supported between the upper surface of the cylinder head 11 and a holder 42 that is joined to the upper surface of the cylinder head 11. The rocker arms 44*a*, 44*b* are swingably supported by respective rocker arm shafts. The valve operating mechanism 40 is covered with a cover 41 that is attached to the upper surface of the cylinder head 11**.

Figure 2:
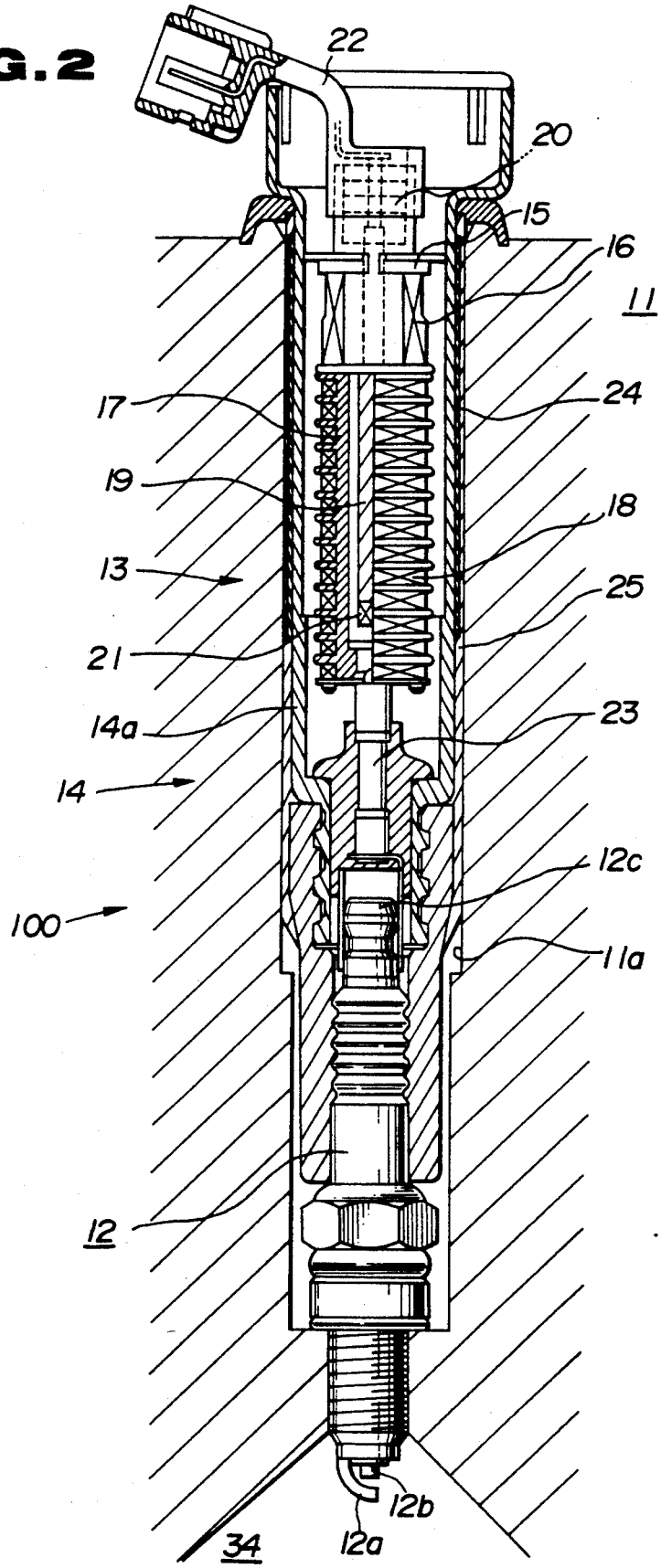
FIG. 2 is an enlarged longitudinal cross-sectional view of the ignition system shown in FIG. 1.

The cylinder head 11 and the holder 42 have a plug insertion hole **11*a* defined therethrough. As shown in FIG. 2, an ignition plug 12 is inserted in the plug insertion hole 11*a*, the ignition plug 12 having a ground electrode 12*a* and a central electrode 12*b* on its lower end. The ground and central electrodes 12*a*, 12*b* are exposed in the combustion chamber 34. The ignition plug 12 also has an input terminal 12*c* on its upper end that is covered with a plug cap 14 that is substantially disposed and extends in the plug insertion hole 11*a*. The plug cap 14 accommodates an ignition coil assembly 13** therein.

The plug cap 14 has a substantially cylindrical housing **14*a* made of phenolic resin or the like, an intermediate tubular shield member 24 disposed around the housing 14*a*, and an outer tubular insulating member 25 disposed around the housing 14*a* and the shield member 24. The plug cap 14 is tightly fitted in the plug insertion hole 11*a*. The shield member 24 is made of a magnetic material having a large electric resistance, such as silicon steel plate or the like, and covers substantially the entire axial length of the ignition coil assembly 13**.

Figure 3:
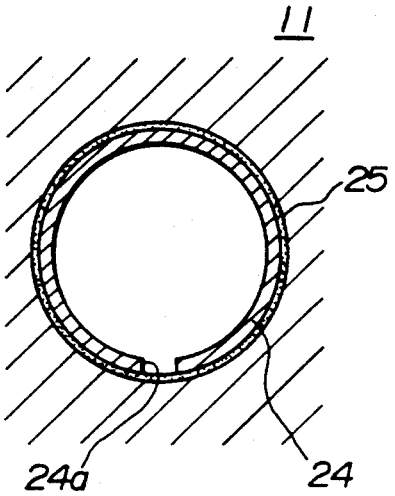
FIG. 3 is a transverse cross-sectional view of a shield member of a plug cap of the ignition system.

As shown in FIG. 3, the shield member 24 has an axial slit **24*a* defined in a circumferential portion thereof, the axial slit 24*a*** extending the full axial length thereof.

The insulating member 25 is made of an electrically insulating material such as fluoroplastic, and electrically insulates the shield member 24 from the metallic cylinder head 11.

The ignition coil 13 comprises primary and secondary coils 16, 18 that are wound around substantially cylindrical bobbins 15, 17, respectively. The primary coil 16 is electrically connected to a power supply (not shown) through a low-tension cord 22, and the secondary coil 18 is electrically connected to the input terminal **12*c* of the ignition plug 12 through a resistor 23. The bobbins 15, 17 are joined to each other in vertically coaxial relationship, with a ferrite core 19 extending through the bobbins 15, 17. The ferrite core 19 has an overall length substantially equal to the sum of the axial lengths of the primary and secondary coils 16, 18. Magnets 20, 21 are fixed respectively to the upper and lower ends of the ferrite core 19. The magnets 20, 21 are oriented so as to produce magnetic fluxes in a direction opposite to magnetic fluxes B (see FIG. 4) that are produced by a magnetic field H generated by the primary coil 16**.

When a pulsed current is supplied to the primary coil 16, the magnetic field H is generated by the primary coil 16. The magnetic field H produces the magnetic fluxes B depending on the magnetic permeability of the core 19, and the secondary coil 18 induces an electromotive force depending on a change $\Delta B$ in the magnetic fluxes B. The induced electromotive force is transmitted to the ignition plug 12, producing a spark between the electrodes **12*a*, 12*b* to ignite an air-fuel mixture in the combustion chamber 34. Since no high-tension cord is employed in the ignition system 100, the ignition system 100** has high maintenability.

Figure 4:
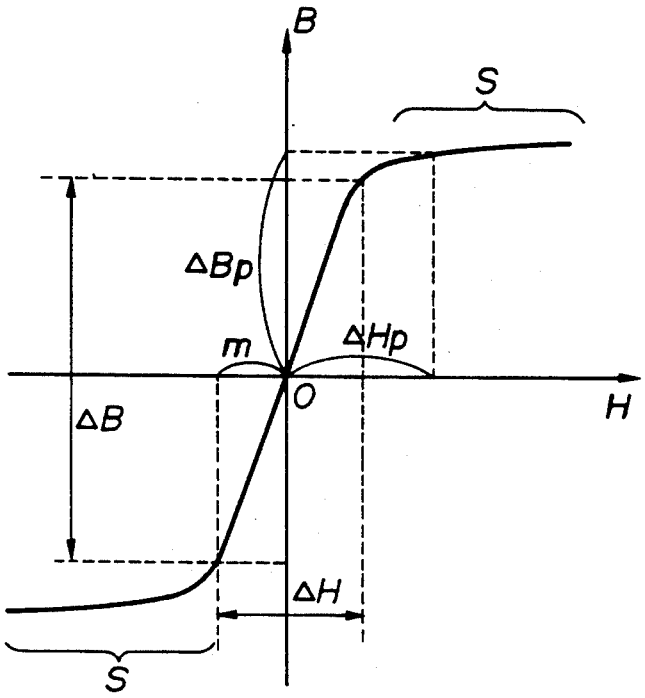
FIG. 4 is a diagram showing the relationship between a magnetic field generated by a primary coil and magnetic fluxes produced by the magnetic field, the diagram being used for comparison between a conventional ignition system and the ignition system according to the present invention.

The magnets 20, 21 serve to produce a negative bias magnetic field, whose absolute magnitude is m (FIG. 4), with respect to the magnetic field H produced by the primary coil 16. Therefore, as shown in FIG. 4, when the magnetic field H produced by the primary coil 16 varies by $\Delta H$, the magnetic fluxes B produced through the core 19 vary by $\Delta B$. ($|\Delta H| = |\Delta Hp|$, $|\Delta B| = |\Delta Bp|$) Therefore, the secondary coil 18 is capable of generating a desired voltage, preventing the output voltage of the ignition coil assembly 13 from being lowered.

As described above, the shield member 24 of magnetic material with the slit **24*a* is positioned between the ignition coil assembly 13 and the metallic cylinder head 11, and the insulating member 25 is interposed between the metallic cylinder head 11 and the shield member 24. The shield member 24 provides a bypass path for the magnetic fluxes produced by the ignition coil assembly 13 for thereby preventing leakage fluxes from going from the ignition coil assembly 13 to the cylinder head 11. As a consequence, no eddy current is induced in the cylinder head 11. This is also effective to prevent the output voltage of the ignition coil assembly 13** from being lowered.

Figure 5:
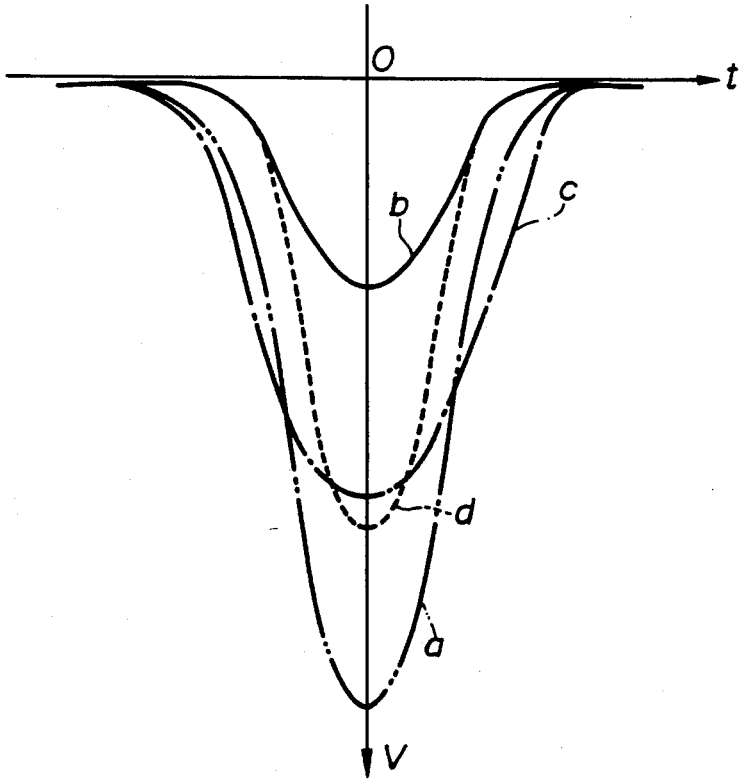
FIG. 5 is a diagram showing the relationship between time and a voltage generated by a secondary coil, the diagram being used for comparison between the conventional ignition system and the ignition system according to the present invention.

FIG. 5 shows the relationship between time t and a voltage kV generated by the secondary coil 18, plotted when a single current pulse is applied to the primary coil 16. The plotted curves a, b, c, d in FIG. 5 represent the respective characteristics of the following four different ignition system structures:

a: The ignition coil assembly 13 itself.

b: The ignition coil assembly 13 inserted in the plug insertion hole **11 *a* without the shield member 24 and the insulating member 25**.

c: The ignition coil assembly 13 inserted in the plug insertion hole **11*a* with the shield member 24 and the insulating member 25. However, a magnet is mounted o only one end of the core 19**.

d: The ignition coil assembly 13 inserted in the plug insertion hole **11*a* with the shield member 24 and the insulating member 25. Two magnets are mounted on the respective ends of the core 19. This structure is the same as the ignition system shown in FIGS. 1 through 3**.

The characteristic curves c, d have maximum values that are about 60% and 70%, respectively, of the maximum value of the characteristic curve a.

According to the present invention, as described above, since no high-tension cord is employed, the ignition system 100 has high maintenability. The ignition system 100 is also effective to efficiently prevent the output voltage of the ignition coil assembly 13 from being lowered.

While the magnets 20, 21 are mounted respectively on the opposite ends of the core 19 in the illustrated embodiment, a magnet may be mounted on only one end of the core 19. The intermediate shield member 24 may be disposed inside the housing 14*a* that is an insulating member itself. The core 19 may be made of a silicon steel plate or the like.

The ignition system according to the present invention may be incorporated in all kinds of internal combustion engines including two-stroke engines, four-stroke engines, and rotary engines, and irrespective of the number of cylinders employed.

Although there has been described what is at present considered to be the preferred embodiment of the invention, it will be understood that the invention may be embodied in other specific forms without departing from the essential characteristics thereof. The present embodiment is therefore to be considered in all respects as illustrative, and not restrictive. The scope of the invention is indicated by the appended claims rather than by the foregoing description.

I claim:

1. An ignition system of an internal combustion engine including a cylinder head having a plug insertion hole, a combustion chamber, an ignition plug inserted in the plug insertion hole and having electrodes exposed in the combustion chamber, the ignition plug having an input terminal, a plug cap covering the input terminal of the ignition plug, and an ignition coil assembly having a primary coil, a secondary coil, and a core extending through the primary and secondary coils, the ignition coil assembly being disposed in the plug cap, wherein the improvement comprises:

magnets mounted on respective ends of the core, said magnets being oriented so as to produce magnetic fluxes in a direction opposite to magnetic fluxes generated by the primary coil.

2. An ignition system according to claim 1, further comprising a shield member of a magnetic material surrounding the ignition coil assembly, and an insulating member of an electrically nonconductive material interposed between said shield member and an inner wall surface of the plug insertion hole.

3. An ignition system according to claim 2, wherein said shield member is of a substantially cylindrical shape having an electrically nonconductive insulating region in a circumferential portion thereof.

4. An ignition system of an internal combustion engine including a cylinder head having a plug insertion hole, a combustion chamber, an ignition plug inserted in the plug insertion hole and having electrodes exposed in the combustion chamber, the ignition plug having an input terminal, a plug cap covering the input terminal of the ignition plug, and an ignition coil assembly having a primary coil, a secondary coil, and a core extending through the primary and secondary coils, the ignition coil assembly being disposed in the plug cap, wherein the improvement comprises:

a shield member of a magnetic material surrounding the ignition coil assembly and electrically insulated from the cylinder head.

5. An ignition system for controlling an ignition plug inserted in its entirety in a plug insertion hole defined in a metallic portion of an internal combustion engine, said ignition system comprising:

an ignition coil assembly inserted substantially in its entirety in the plug insertion hole;

said ignition coil assembly comprising a primary coil adapted to be electrically connected to a power supply, a secondary coil electrically connected to the ignition plug, and a core extending through said primary and secondary coils; and magnets oriented so as to produce magnetic fluxes in a direction opposite to magnetic fluxes generated by said primary coil.

6. An ignition system according to claim 5, further comprising a shield member surrounding said ignition coil assembly in its entirety within the plug insertion hole and providing a bypass passage for the magnetic fluxes, for preventing leakage fluxes from going from said ignition coil assembly to the metallic portion of the internal combustion engine, said shield member having a slit for preventing an eddy current from being induced in said shield member by the magnetic fluxes.

7. An ignition system according to claim 6, further comprising an insulating member interposed between said shield member and the metallic portion of the internal combustion engine, for electrically insulating said shield member and the metallic portion from each other.

8. An ignition system for controlling an ignition plug inserted in its entirety in a plug insertion hole defined in a metallic portion of an internal combustion engine, said ignition system comprising:

an ignition coil assembly inserted substantially in its entirety in the plug insertion hole;

said ignition coil assembly comprising a primary coil adapted to be electrically connected to a power supply, a secondary coil electrically connected to the ignition plug, and a core extending through said primary and secondary coils;

a shield member surrounding said ignition coil assembly in its entirety within the plug insertion hole and providing a bypass passage for the magnetic fluxes, for preventing leakage fluxes from going from said ignition coil assembly to the metallic portion of the internal combustion engine; and said shield member having a slit for preventing an eddy current from being induced in said shield member by the magnetic fluxes.

* * * * *